US010982453B2

(12) United States Patent
Caboni

(10) Patent No.: US 10,982,453 B2
(45) Date of Patent: Apr. 20, 2021

(54) VARIABLE-GEOMETRY SPACING CONNECTOR FOR FORMWORK AND MODULAR FORMWORK SYSTEM INCLUDING SUCH CONNECTOR

(76) Inventor: Michele Caboni, Oristano (IT)

( * ) Notice: Subject to any disclaimer, the term of this patent is extended or adjusted under 35 U.S.C. 154(b) by 0 days.

(21) Appl. No.: 13/979,575

(22) PCT Filed: Jan. 10, 2012

(86) PCT No.: PCT/IT2012/000008

§ 371 (c)(1),
(2), (4) Date: Jul. 12, 2013

(87) PCT Pub. No.: WO2012/095884

PCT Pub. Date: Jul. 19, 2012

(65) Prior Publication Data

US 2013/0284883 A1 Oct. 31, 2013

(30) Foreign Application Priority Data

Jan. 13, 2011 (IT) ..... TO2011A0011

(51) Int. Cl.
*E04B 2/86* (2006.01)
*E04G 17/06* (2006.01)
*E04G 9/02* (2006.01)

(52) U.S. Cl.
CPC ..... *E04G 17/06* (2013.01); *E04B 2/8641* (2013.01); *E04G 9/02* (2013.01); *E04B 2002/8676* (2013.01); *Y10T 403/21* (2015.01)

(58) Field of Classification Search
CPC ... E04B 1/16; E04B 1/167; E04B 1/70; E04B 1/7069; E04B 1/7076; E04B 1/7084; E04B 2/8635; E04B 2/8641
USPC ..... 52/426, 220.1, 220.8, 302.1, 310
See application file for complete search history.

(56) References Cited

U.S. PATENT DOCUMENTS

| | | | | |
|---|---|---|---|---|
| 3,151,391 A | | 10/1964 | Ollier | |
| 4,136,798 A | | 1/1979 | Oberstein | |
| 4,472,331 A | | 9/1984 | Kida | |
| 4,519,415 A | * | 5/1985 | Carn | 137/318 |
| 4,691,487 A | * | 9/1987 | Kessler | 52/209 |
| 4,731,968 A | | 3/1988 | Obino | |
| 4,833,857 A | | 5/1989 | Wheeler | |
| 5,224,799 A | * | 7/1993 | Parker | 405/229 |
| 5,383,319 A | | 1/1995 | Sorqvist | |

(Continued)

FOREIGN PATENT DOCUMENTS

| | | |
|---|---|---|
| CA | 2264099 | 2/1998 |
| CH | 367966 | 3/1963 |

(Continued)

OTHER PUBLICATIONS

International Search Report for PCT/IT2012/000008, Completed by the European Patent Office on Apr. 23, 2012, 2 Pages.

*Primary Examiner* — Michael Safavi

(57) ABSTRACT

A spacing connector used for assembling formworks and made up of at least one crosspiece, the crosspiece being connected, at both of its opposite ends, with at least one respective connection portion suited to make a connection with at least one panel of such formwork, the spacing connector also including at least one transpiration duct featuring two respective end openings, each of the end openings leading to a respective connection portion. Also disclosed is a formwork system including the spacing connectors.

15 Claims, 18 Drawing Sheets

(56) References Cited

U.S. PATENT DOCUMENTS

| | | | | |
|---|---|---|---|---|
| 5,428,933 | A | 7/1995 | Philippe | |
| 6,370,831 | B1 | 4/2002 | Marshall et al. | |
| 7,076,925 | B2 * | 7/2006 | Gagliano | 52/155 |
| 7,082,732 | B2 | 8/2006 | Titishov | |
| 8,181,414 | B2 | 5/2012 | Garrett | |
| 2004/0103609 | A1 | 6/2004 | Wostal et al. | |
| 2005/0028466 | A1 | 2/2005 | Titishov | |
| 2007/0214740 | A1 | 9/2007 | O'Grady | |
| 2008/0172972 | A1 | 7/2008 | Williams | |
| 2009/0044481 | A1 | 2/2009 | Turek | |
| 2010/0065716 | A1 | 3/2010 | Amend | |

FOREIGN PATENT DOCUMENTS

| | | |
|---|---|---|
| DE | 2013630 | 11/1971 |
| DE | 3410484 | 10/1985 |
| DE | 9418036 | 1/1995 |
| DE | 4332115 | 3/1995 |
| DE | 29611835 | 11/1996 |
| DE | 102008050741 | 4/2010 |
| EP | 0137105 | 4/1985 |
| EP | 0163117 | 12/1985 |
| EP | 0368804 | 5/1990 |
| EP | 0803618 | 10/1997 |
| EP | 1092816 | 4/2001 |
| EP | 1605113 | 12/2005 |
| FR | 663193 | 8/1929 |
| FR | 2328814 | 5/1977 |
| FR | 2813903 | 3/2002 |
| FR | 2874950 | 3/2006 |
| JP | 2002348858 | 12/2002 |
| WO | 9119055 | 12/1991 |
| WO | 03046310 | 6/2003 |
| WO | 2005014948 | 2/2005 |
| WO | 2005035898 | 4/2005 |
| WO | 2005061804 | 7/2005 |
| WO | 2006063140 | 6/2006 |
| WO | 2006081678 | 8/2006 |
| WO | 2008098686 | 8/2008 |

* cited by examiner

VARIABLE-GEOMETRY SPACING CONNECTOR FOR FORMWORK AND MODULAR FORMWORK SYSTEM INCLUDING SUCH CONNECTOR

CROSS-REFERENCE TO RELATED APPLICATION

This application is the U.S. national phase of PCT Application No. PCT/IT2012/000008 filed on Jan. 10, 2012, which claims priority to Italian Patent Application No. TO2011A000011 filed on Jan. 13, 2011, the disclosures of which are incorporated in their entirety by reference herein.

This invention pertains to a variable-geometry spacing connector used, in particular, to assemble formworks for making concrete cast monolith separators, as well as to a modular formwork system including such connector.

Notedly, a formwork is a structure used in the building and construction trade to build the reinforced concrete works. It provides a casing into which the concrete in the liquid state is cast, after the reinforcement irons have been properly positioned, where the concrete stays until the completion of the setting process and after the cast has, once the hardening phase has started, achieved such mechanical strength as to guarantee the absorption of the stress which the structure has to withstand soon after the formwork itself has been taken apart.

Formworks can be made of several materials; in particular, formworks are currently available, which are made up of polystyrene foam panels made by means of the technique generally referred to as Insulated Concrete Form (ICF), as well as of their respective spacing connectors, which are disposable items needed for the assembling and internal blocking of the various aforesaid panels making up the shuttering mould and/or formwork of a reinforced concrete wall: as a rule, the existing spacing connectors may be both separate, pre-stamped metal elements or plastic elements (i.e. PVC or PP) and elements stamped jointly with the panels themselves. One example of such spacing connectors is described in WO0058577.

Yet, the existing spacing connectors and their respective existing formwork systems still pose a few problems. In fact, the formwork systems in which the panels are stamped jointly with the spacing connectors prove to be quite inefficient in terms of transport, since they feature a very high overall volume generated by geometric shapes branching off to a large extent and, yet, made up mostly of gaps.

To remedy this problem, formwork systems have been proposed for building walls only, which are made up of polystyrene foam panels and separate spacing connectors that will make it possible to achieve smaller overall dimensions (after they are disassembled) and also minimize the transportation and handling costs, despite the formworks themselves feature well-known hollows, which are divided into five classes, starting from 10-15-20-25-30 cm; obviously, the additional reinforced concrete will be cast into such hollows.

All of the "disposable" formwork systems featuring polystyrene foam panels, known as Insulated Concrete Form (or ICF), supplied by American manufacturers also pose transpiration problems, which may lead to building reinforced concrete structures that will, especially in case of civil buildings, give rise to the well-known causes of SBS (Sick Building Syndrome).

Furthermore, the formwork systems featuring polystyrene foam panels (ICF) still pose sound-proofing problems, due to their being unable to adequately break the noise off.

Moreover, the known spacing connectors placed in "disposable" formwork built by applying the ICF method feature standard lengths starting from 10 cm and reaching, by multiples of five, a maximum length of 30 cm. Such a maximum length is determined by the poor structural strength of such connectors: this will make it mandatory, in the event that the width between the two panels mutually facing each other and making up the ICF formwork has to be greater than 30 cm, to join several connectors to one another in series, in a telescopic fashion, by means of suitable "junction bridles".

Furthermore, the known spacing connectors placed in the "disposable" formworks built by applying the ICF method may guarantee the positioning, despite not being fully constrained, of reinforcement irons in the horizontal direction only by steps of 30 cm—they will allow no constrained vertical positioning of such irons to such an extent that they will not guarantee homogeneous bar covering, as laid down by the international technical standards in order to obtain masonry complying with the service life requirements and the fire protection regulations.

Thus, the aim of this invention is to solve the above-mentioned problems relative to the older method, by providing a spacing connector used, in particular, for assembling transpiring, thermal-acoustic "disposable" formworks, equipped with at least one transpiration duct that will make it possible to facilitate transpiration between the inner panel plus the structural concrete separator and the outer panel making up such transpiring, thermal-acoustic "disposable" formwork.

One further aim of this invention is to provide a spacing connector featuring such a structural strength that will allow such spacing connector to be manufactured and used at least at a length of 150.00 cm, to be obtained, for instance, by measurement multiples of 2.50 cm and submultiples of 1.25 cm, indeed with no constraint at all on the length of such connectors.

One further aim of this invention is to provide a Spacing connector that will allow fully constrained positioning of reinforcement irons both in the horizontal direction and the vertical direction, in such a manner (if possible) as to create a fully reticular wide reinforcement with no measurement constraints for such grid.

One further aim of this invention is to provide a system relative to a transpiring, thermo-acoustic "disposable" formwork, including polystyrene foam panels and spacing connectors, each of them equipped with at least one transpiration duct, such that they will form a homogeneous transpiration grid inside such formwork between the inside and outside of said panels.

Moreover, one further aim of this invention is to provide a system relative to a transpiring, thermo-acoustic "disposable" formwork, preferably including extruded polystyrene and/or polystyrene foam panels as well as spacing connectors, each of them equipped with at least one transpiration duct, such that it will allow the overlapping connection of several such panels (even made of different materials) to achieve better sound proofing of the transpiring, thermo-acoustic "disposable" formwork itself.

The above and the other aims and advantages of the invention, as, detailed in the description hereafter, will be obtained by making use of a variable-geometry spacing connector to be used with transpiring, thermo-acoustic "disposable" formworks.

Moreover, the above and the other aims and advantages of the invention, as detailed in the description hereafter will be obtained by making use of a formwork system featuring a modular design of all of its components and/or elements.

It is obvious that a number of variants and modifications can be made to the described items (e.g. variants and modifications concerning the shape and dimensions, as well as the arrangements and the parts performing equivalent functions) without departing from the scope of protection of the invention, as referred to in the claims.

This invention will be best described by a few preferred embodiments, which will be provided by way of example and with no limitation thereto, with reference to the enclosed drawings, where:

Figure 17A:
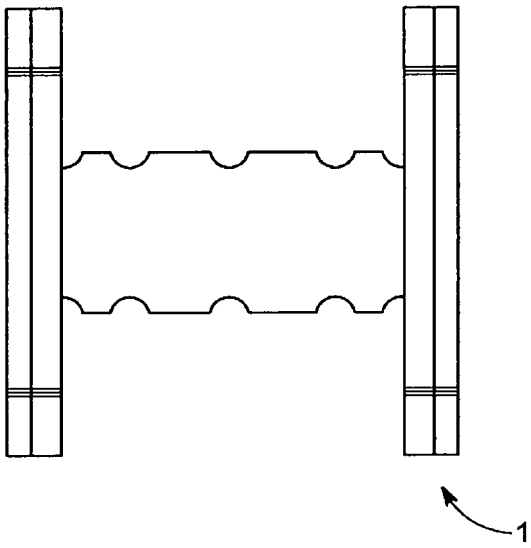
Figure 17B:
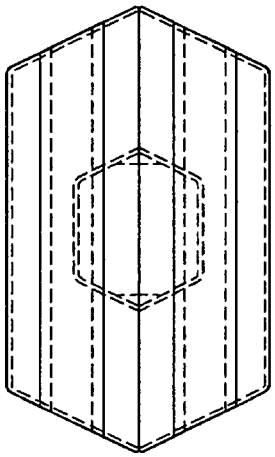
Figure 17C:
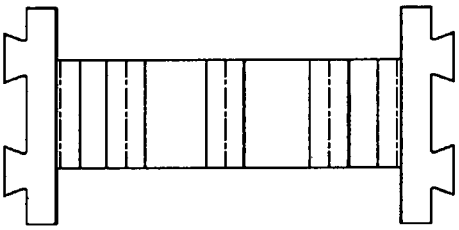
Figure 18A:
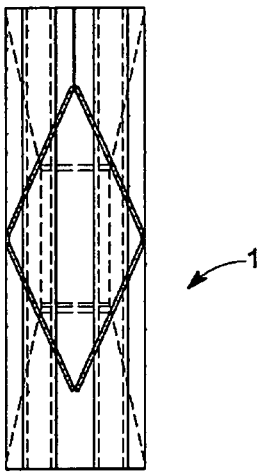
Figure 18B:
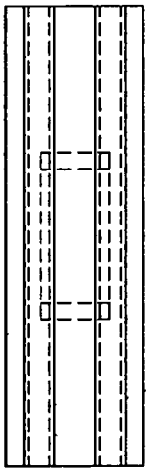
Figure 18C:
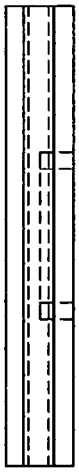
Figure 18D:
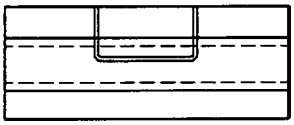
Figure 19A:
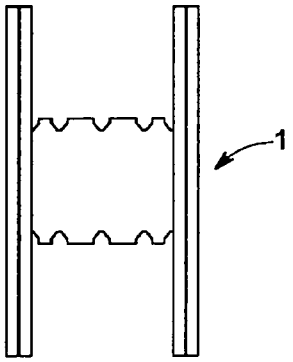
Figure 19B:
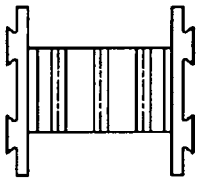
Figure 20A:
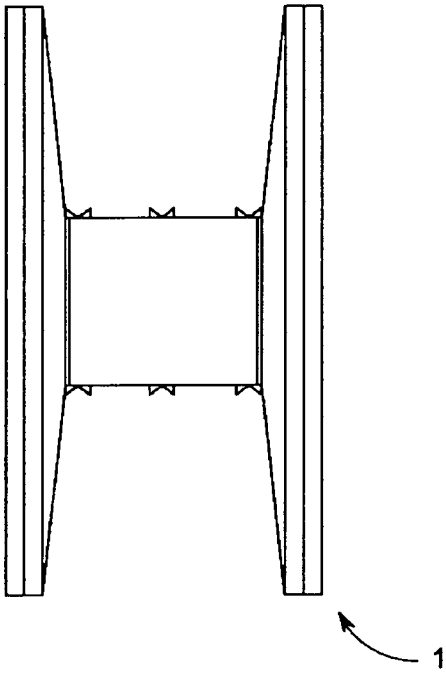
Figure 20B:
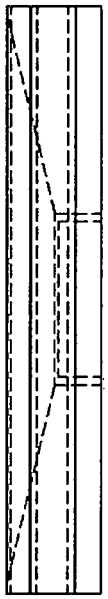
Figure 20C:
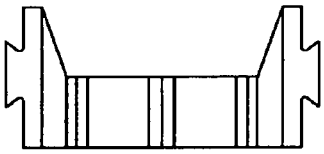

FIGS. 17A, 17B, and 17C show another preferred construction variant (by way of example with no limitations) of the connector referred to in the present invention;

FIGS. 18A, 18B, 18C, and 18D show another preferred construction variant (by way of example with no limitations) of the connector referred to in the present invention;

FIGS. 19A, 19B, and 19C, show another preferred construction variant (by way of example with no limitations) of the connector referred to in the present invention; and FIGS. 20A, 20B and 20C, show another preferred construction variant (by way of example with no limitations) of the connector referred to in the present invention.

By referring to the Figures, you can notice that the variable-geometry spacing connector 1 referred to in the present invention is made up of at least one crosspiece 3, such crosspiece 3 being connected, at the two opposite ends of its, with at least one respective connection portion 5 suited to make a connection with at least one panel 10 of a transpiring, thermo-acoustic "disposable" formwork 11.

Productively, spacing connector 1 referred to in the present invention will also include at least one transpiration duct featuring two respective end openings 15, each of them leading to a respective connection portion 5. Such transpiration duct is therefore suited to get the panels 10 (among which the spacing connector 1 referred to in this invention is placed) connected and also allow transpiration among such panels 10, in particular from the inner panel towards the outer panel due to the pressure difference obviously found between the aforesaid end openings 15. In addition, the transpiration duct may be equipped with at least one check device (such as, for instance, a check valve) suited to act in favour of the above-mentioned pressure difference and also enhance the efficiency of the process of transpiration and discharge of saturated steam by means of spacing connector 1 referred to in the present invention.

Figure 1:
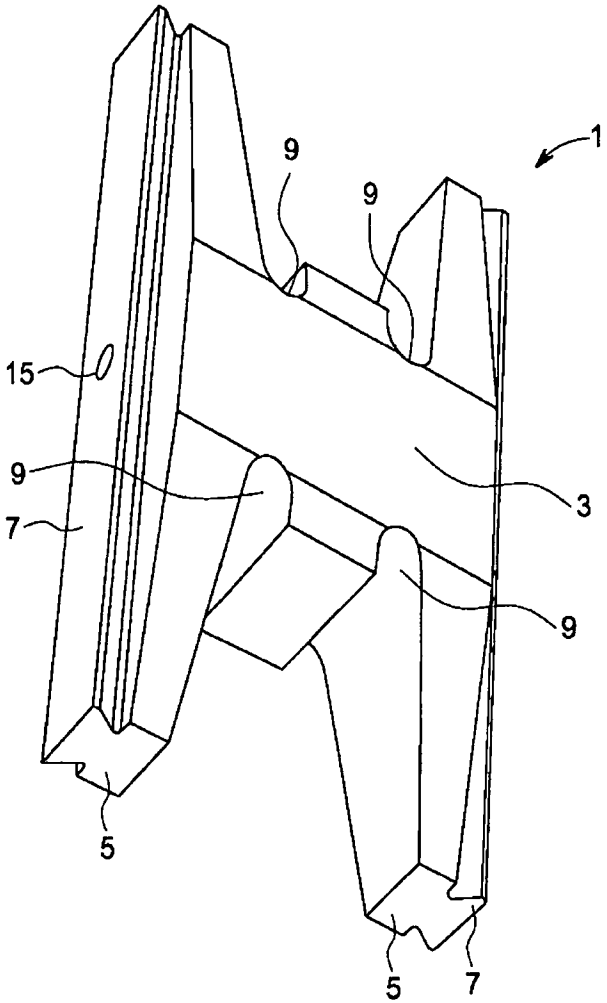
FIG. 1 shows a perspective top view of a preferred embodiment of the spacing connector in accordance with the present invention.
Figure 2:
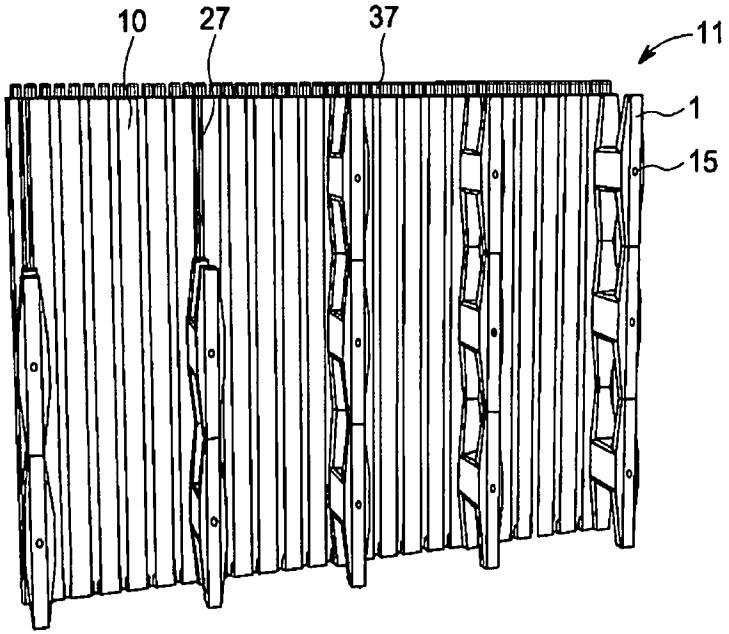
FIG. 2 shows a perspective view of one portion of a system relative to a transpiring, thermo-acoustic "disposable" formwork in accordance with the present invention, including a plurality of spacing connectors of the type shown in FIG. 1.
Figure 3:
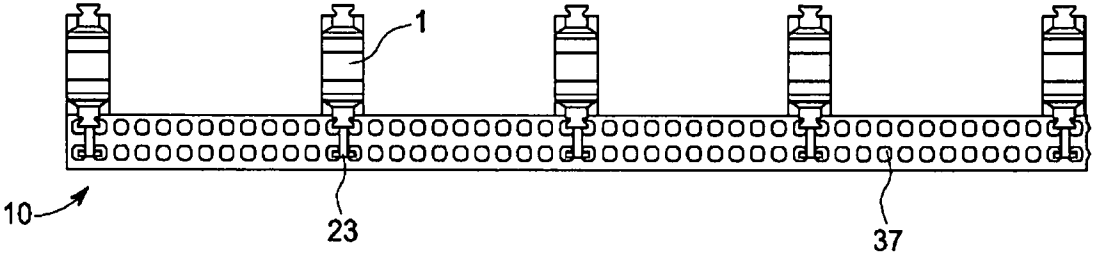
FIG. 3 shows a top view of a system relative to a transpiring, thermo-acoustic "disposable" formwork in accordance with the present invention, including a plurality of spacing connectors of the type shown in FIG. 1.
Figure 4:
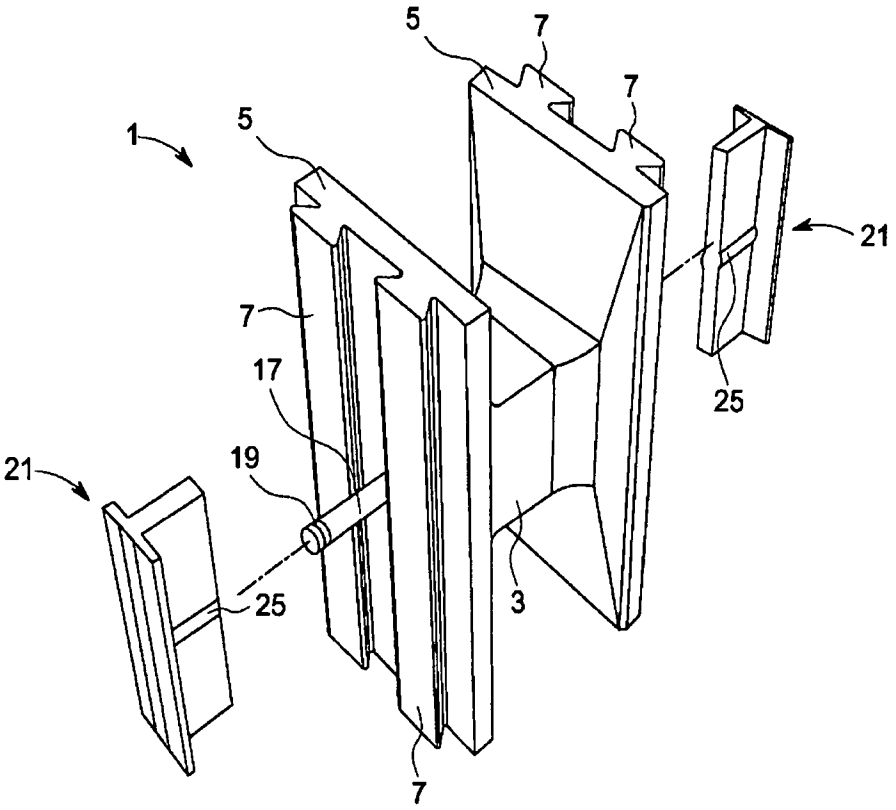
FIG. 4 shows a perspective top view of another preferred embodiment of the connector and/or spacer in accordance with the present invention.

As you can notice in FIGS. 1 and 4, the transpiration duct may preferably made up of at least one pipe 17 running through the crosspiece 3 between the connection portions 5.

Figure 6:
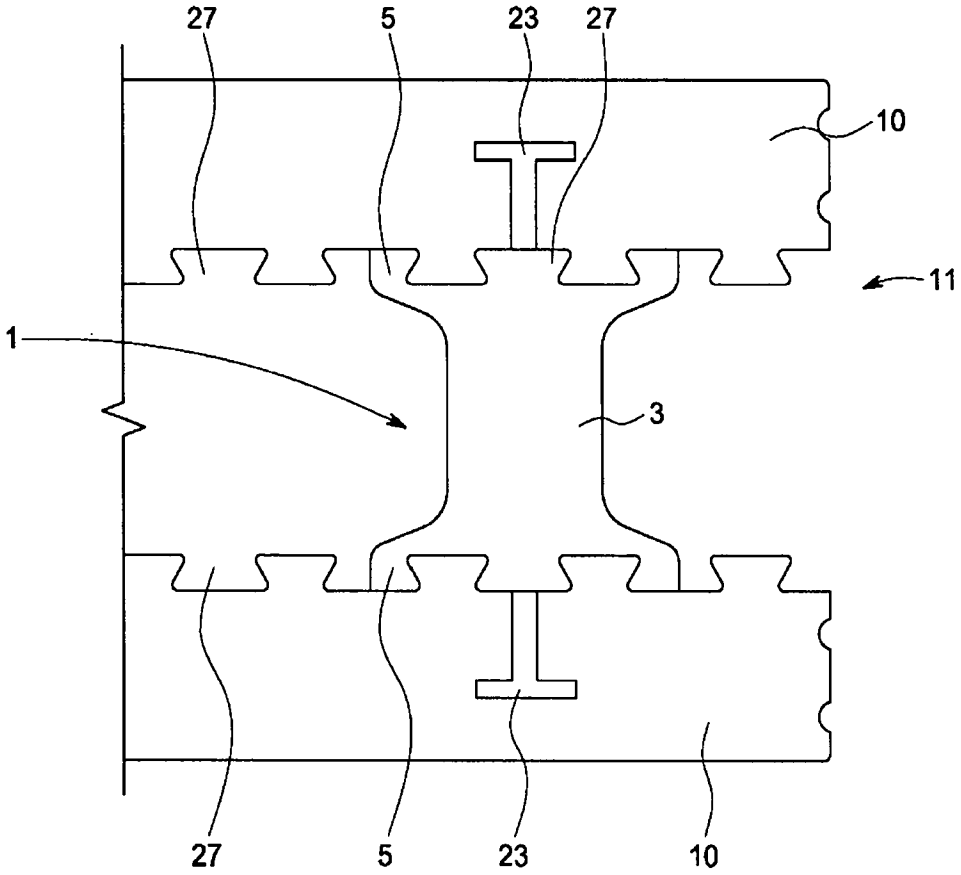
FIG. 6 shows a top view of a system relative to a transpiring, thermo-acoustic "disposable" formwork in accordance with the present invention, including one further preferred embodiment of the spacing connector referred to in the present invention.

In addition, as you can notice in FIG. 6 in particular, each end of such pipe 17 may feature at least one thread 19 through which at least one additional lock-in profile 21 (normally referred to as "bridle") can be connected, said lock-in profile featuring such a section as a form essentially shaped like a "T" and/or "H" and being suited to fit into a corresponding profile 23 of panel 10 in order to increase the tensile strength offered by spacing connector 1 referred to in the present invention: each of said lock-in profiles 21 also features at least one through hole 25 corresponding with the respective end opening 15 of the transpiration duct.

Figures 11A, 11B:
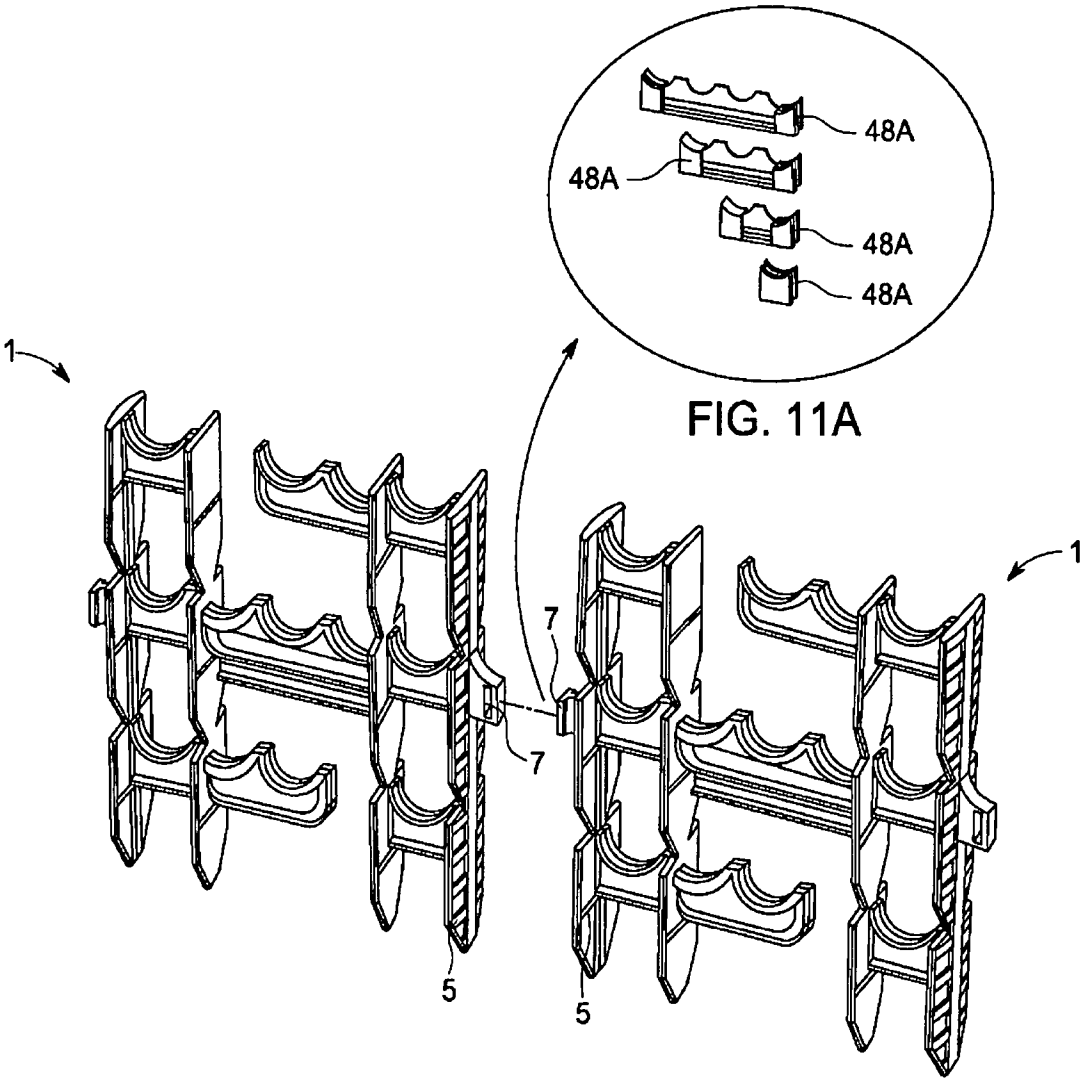
FIG. 11A is an enlarged view of a portion of FIG 11B.
FIG. 11B shows a perspective front view of one more preferred embodiment of the spacing connector referred to in the present invention.

References below to FIG. 11 should be understood to refer to FIGS. 11A and 11B.

Figure 10:
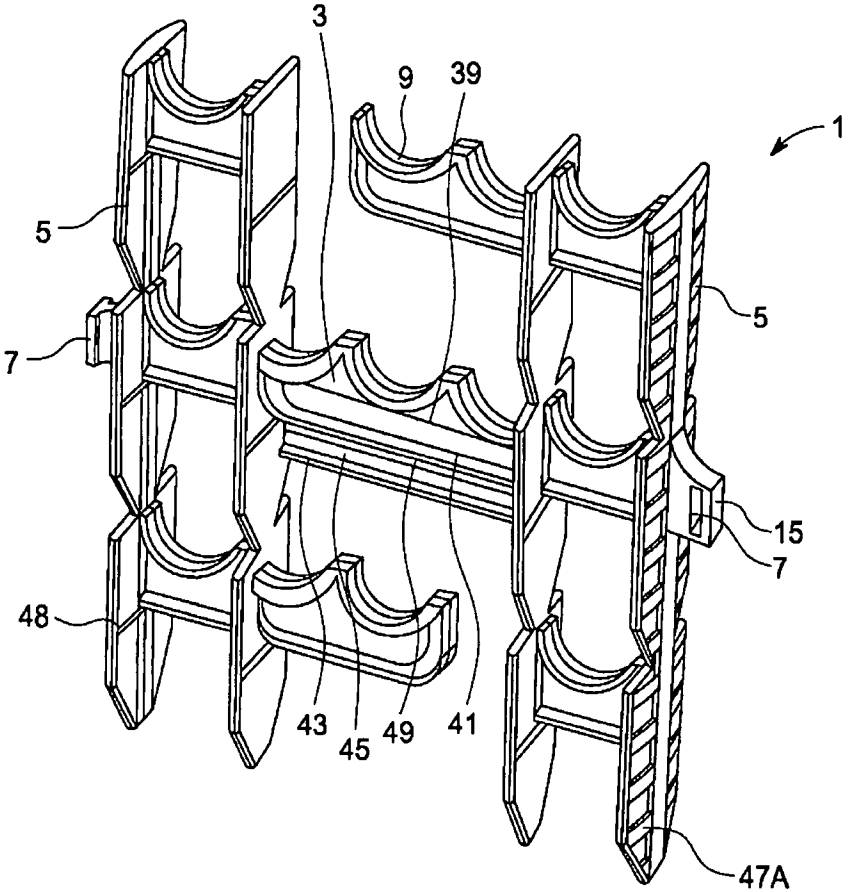
FIG. 10 shows a perspective front view of one further preferred embodiment of the spacing connector referred to in the present invention.

As an alternative, as you can notice in FIGS. 10 and 11, the transpiration duct may be made up of at least one first partition 39, including essentially one first half 41 of such duct, connected to one second partition 43, including essentially the second half 45 of the duct itself, by placing at least one hinged mechanism 49 in between. This preferred variant will productively make it possible to significantly simplify the processes for manufacturing the spacing connector 1 referred to in the present invention since component parts 39 and 43 making up the transpiration duct will be able to be made by means of one single stamping operation: in fact, it will subsequently be enough, during the assembling phase, to shut the second partition 39 on the first partition 43 to obtain a smooth transpiration duct, for vapour or condensate outflow. In addition, the aforesaid variant will also make it possible to make, along the partitions implementing the transpiration duct, the well suited to accommodate the check valve and the positioning of the valve itself prior to shutting the second partition 43 on the first partition 39. In the event that the spacing connector 1 referred to in the present invention is made of a plastic material, the hinged mechanism can productively be realized in the mere form of a line necking such plastic material.

Furthermore, in order to allow reinforcement irons 13 to be positioned accurately, the connection portions 5 may be equipped with at least one respective removable fin 47A: in particular, the removable fin 47A can be taken off the connection portion 5 by being broken along a score line 48 so as to alter the height of positioning of spacing connector 1 along the panel 10 of the transpiring, thermo-acoustic "disposable" formwork 11 once said lock-in profile 5 has been inserted into the respective lock-in profile of the panel itself, and also allow spacing connector 1 to be positioned heightwise to a high degree of accuracy.

Obviously, depending on the width to be obtained between panels 10 of the transpiring, thermo-acoustic "disposable" formwork 11, several spacing connectors 1 as referred to in the present invention can, as shown in FIG. 11 by way of example, be connected in series with one another, until the desired length is reached, for instance by means of modular connecting elements 48A properly shaped to correspond with the respective connecting means of the respective connection portions 5, such modular connecting element 48A also being preferably equipped with at least one internal channel corresponding with the transpiration ducts of the various spacing connectors 1 connected with one another and being suited to allow continuity among such ducts of connectors 1 connected with one another.

Obviously, the connection portion 5 may be equipped with any one connecting means, be it a mechanical connection means or any one lock-in profile, such as, for instance, at least one dovetail profile 7, which will make it possible to connect the spacing connector 1 referred to in the present invention with the corresponding lock-in profile 27 of any one panel 10, also known in the relevant engineering field without, therefore, departing from the scope of protection of this invention. In particular, please note that also the amount and the arrangements of dovetail profiles 7 can be most varied: in fact, by way of example only, the Figures show a number of alternative examples, with no limitation thereto, in which the quantity, dimensions and forms of dovetail profiles 7 vary (for instance, one male item for connection portion 5 in spacing connector 1 of FIG. 1; two male items for connection portion 5 in spacing connector 1 of FIG. 4; two female items for connection portion 5 in spacing connector 1 of FIG. 6).

Figure 13:
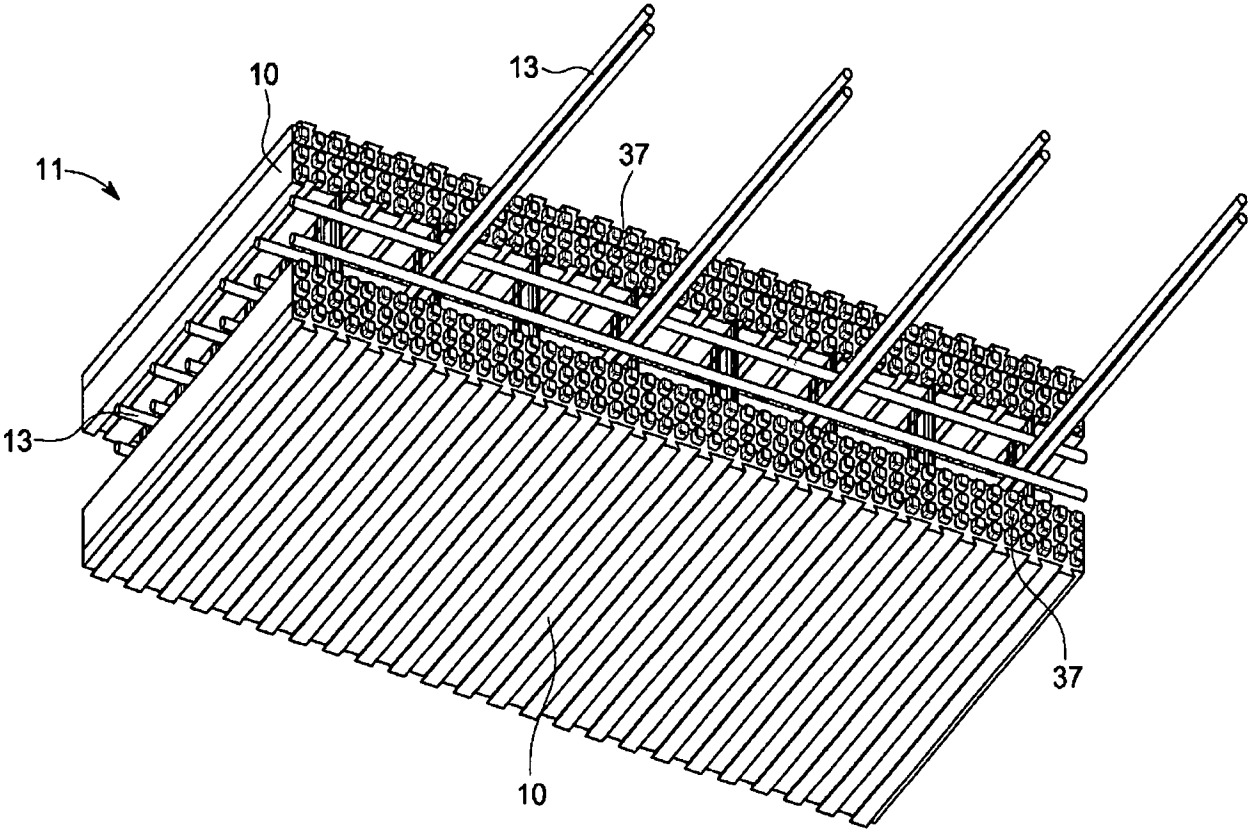
FIG. 13 shows a perspective opt view of the system relative to a transpiring, thermo-acoustic "disposable" formwork in accordance with the present invention, in another possible assembling configuration.

In particular, crosspiece 3 may be equipped with at least one housing seat 9 suited to accommodate at least one reinforcement iron 13. Obviously, the quantity and the arrangement of such seats may be most varied without, therefore, departing from the scope of protection of this invention. In fact, still by way of example only, the Figures show a number of alternative examples, with no limitation thereto, in which the quantity and the arrangements of housing seats 9 vary. Such housing seats 9 should preferably be placed at a pitch of 2.5 cm with respect to one another, so that the reinforcement irons 13 can be arranged horizontally in accordance with said pitch. In addition, as you can notice in FIG. 13 in particular, spacing connector 1 makes it possible to allow constrained positioning of reinforcement irons 13 also vertically, so that a wide reinforcement similar to an electrowelded metal mesh (like the one provided for by the relevant international and UNI Standards) can be obtained.

It is also obvious that spacing connector 1 referred to in this invention can be made of any one materials suitable for the purpose—and, in particular, a plastic material such as polypropylene (also filled with talc) or other materials, with no limitation thereto. In addition, it is obvious, once again, that spacing connector 1 referred to in the present invention can be made both as one single piece in which all of its component parts are made of one single material, and in parts separate from one another and subsequently assembled, even made of different materials from one another, thus without departing from the scope of protection of this invention.

Figure 9:
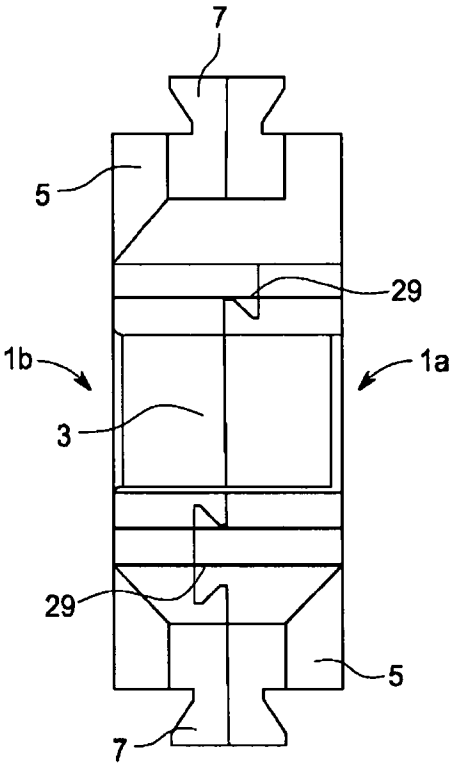
FIGS. 8 and 9 show a perspective top view and a plan view, respectively, of one further preferred embodiment of the spacing connector referred to in the present invention.
Figure 8:
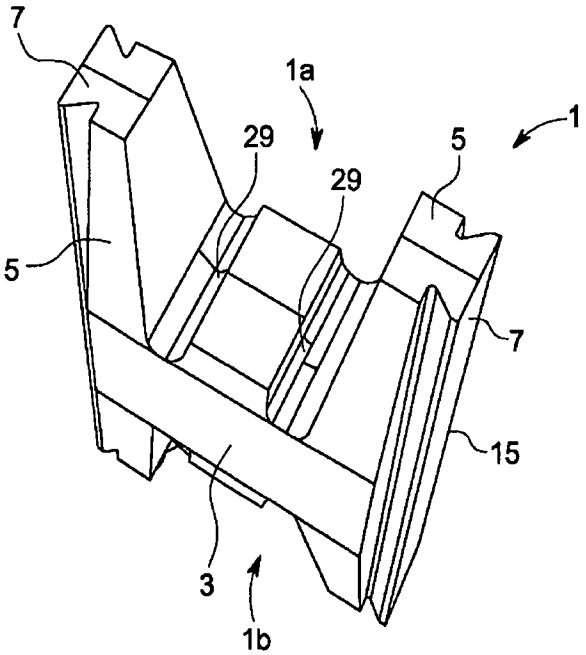

In addition, spacing connector 1 referred to in the present invention may be made up by at least two half-parts (1*a* and 1*b*) that may be made of different materials and can be connected with each other, for instance by means of suitable lock-in profiles 29 reinforced (if necessary) by a plastic bridle (not shown), either horizontally or vertically (as shown, by way of example, in FIGS. 8 and 9) along crosspiece 3 to make up the assembled spacing connector 1. In addition, it can be anticipated that the aforesaid half-parts 1*a* and 1*b* may feature an inner cavity to make it possible to house aerating devices (which can be motor-driven, if needed so). These variants make it possible to obtain the following advantages:

possible reversibility of the individual parts 1*a* and 1*b;* smaller transportation overall dimensions;

simple installation of pipe 17 inside a special seat obtained along crosspiece 3.

Furthermore, the length of spacing connector 1 referred to in the present invention shall preferably be a multiple (by the centimeter) of 1.25: the preferred lengths of spacing connector 1 referred to in the present invention will therefore be, for instance, 1.25 cm, 2.50 cm, 3.75 cm, 5.00 cm, and so on. At least one metal core (not shown) can productively be fitted at least into crosspiece 3, such metal core being suited to further increase the tensile strength and the stiffness offered by spacing connector 1 referred to in the present invention. As an alternative or in addition, still in order to reinforce spacing connector 1 structurally, pipe 17 shall preferably be made of metal: the presence of the metal core and/or of metal pipe 17 will productively make it possible to make and use with the necessary structural reliability spacing connectors 1 (as referred to in the present invention) featuring a length of at least 150.00 cm, with no limitation thereto.

Figure 15:
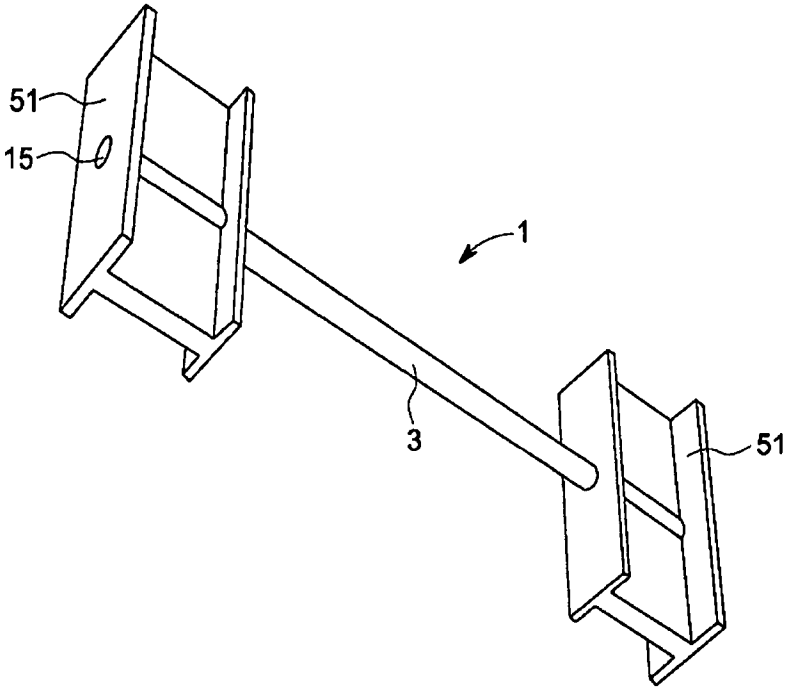
FIG. 15 shows a perspective top view of a preferred embodiment of the spacing connector referred to in the present invention.
Figure 16A:
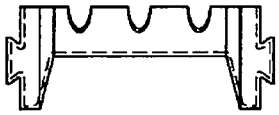
FIGS. 16A, 16B, 16C, 16D, and 16E show one preferred construction variant (by way of example, with no limitations) of the connector referred to in the present invention.
Figure 16B:
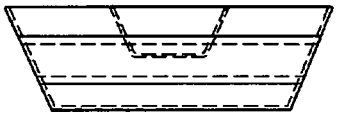
Figure 16C:
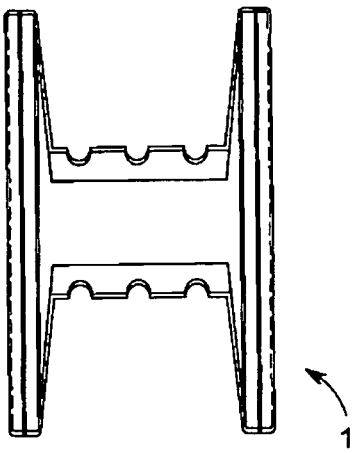
Figure 16D:
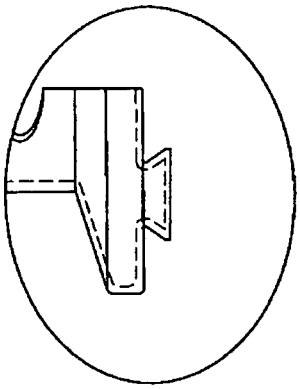
Figure 16E:
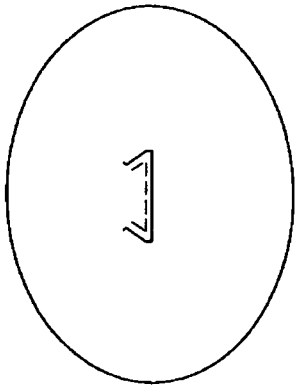

As you can notice in the alternative embodiment (shown in FIG. 15) of connector 1 referred to in the present invention, in the event that the pipe containing the transpiration duct is made of a material featuring a structural strength suitable for the purpose, then the pipe itself may perform the function of crosspiece 3. Here too, each end of the pipe/crosspiece 3 may be equipped with at least one thread by means of which at least a lock-in profile featuring such a section as a form essentially shaped like a "T" and/or "H" (51) can be connected, in order to allow spacing connector 1 to be inserted into the respective profiles of panels 10.

Figure 5:
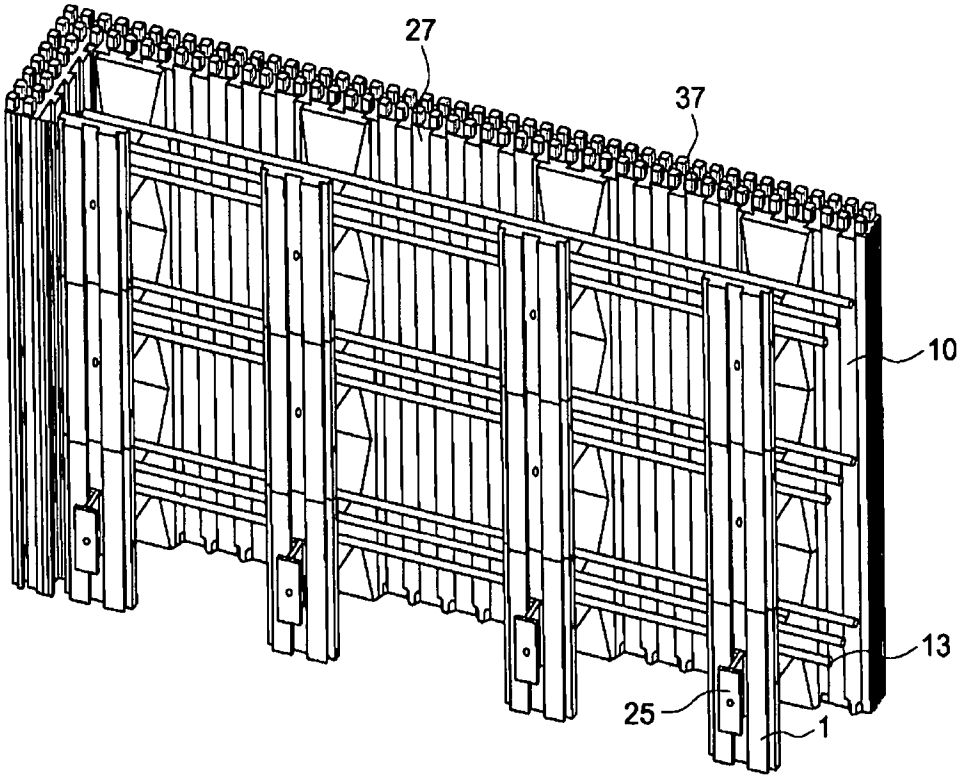
FIG. 5 shows a detailed perspective top view of a system, relative to a transpiring, thermo-acoustic "disposable" formwork in accordance with the present'invention, during the assembling phase, including a spacing connector of the type shown in FIG. 4.

Furthermore, this invention pertains to a dynamic construction system for making a modular, transpiring, thermo-acoustic "disposable" formwork 11 including panels made of any one material 10 as well as spacing connectors 1 like the ones described above: in particular—and by referring to the Figures—you can notice that the dynamic construction system referred to in the present invention includes at least two panels 10, preferably of the polyurethane and/or polyurethane foam type, which are connected with each other by placing said spacing connectors 1 in between. Thus, each panel 10 shall preferably be equipped with a plurality of lock-in profiles 27, each of them shall be coupled (if necessary) with a respective profile 23, such lock-in profiles 27 being suited to make it possible to insert the connecting means, and also, if necessary, of the additional lock-in profile 21 (as shown, by way of example, in FIGS. 4 and 5), of spacing connectors 1 referred to in the present invention. Please note that the quantity and the arrangements of lock-in profiles 13, 27 on panels 10, as well as the quantity and the arrangements of spacing connectors 1 used to make the transpiring, thermo-acoustic "disposable" formwork 11 can productively be most varied, in order to fully meet the various specific construction requirements concerning both the acoustic and thermal performance. Furthermore, each panel 10 may be equipped, as commonly known in the relevant engineering field, with a plurality of engaging teeth 37 suited to make it possible to engage several panels 10 themselves by stacking.

Figure 7:
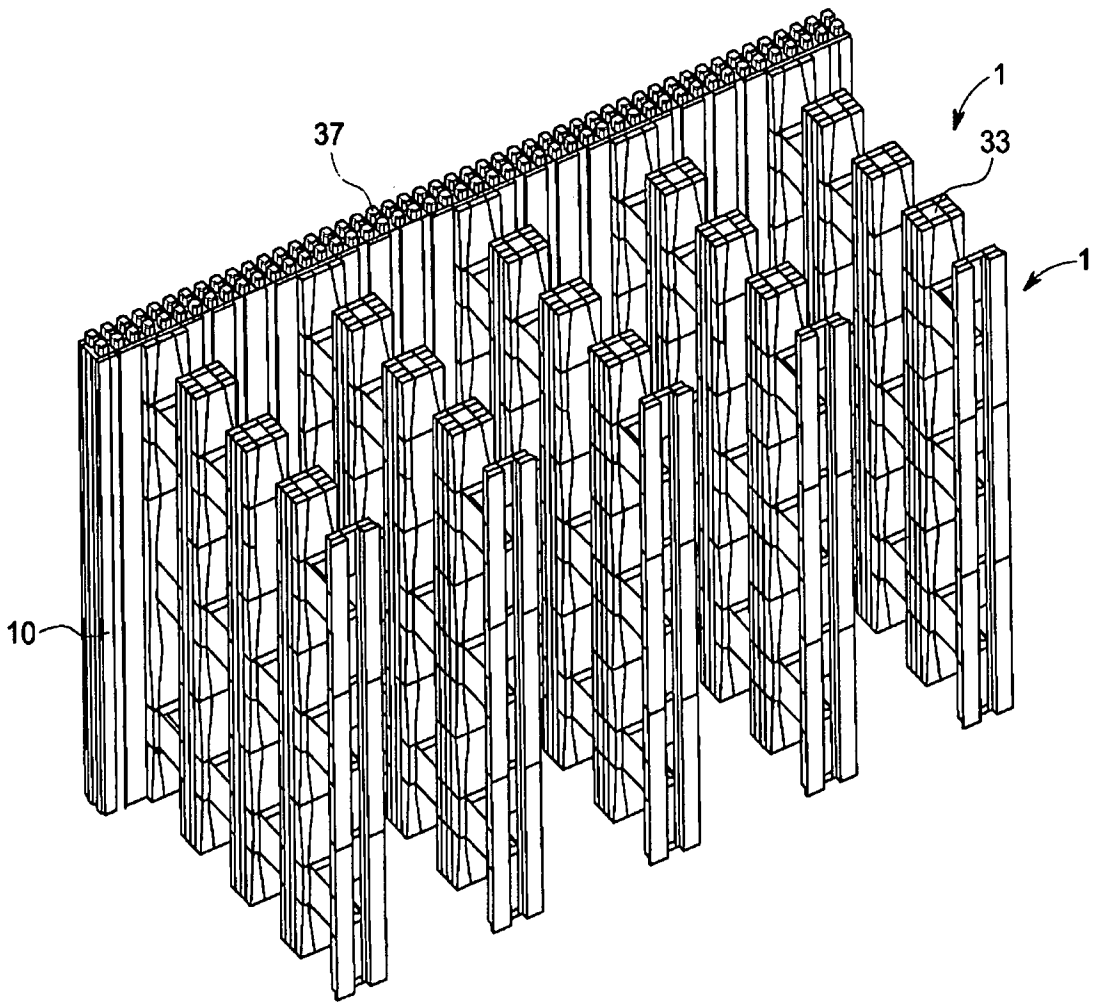
FIG. 7 shows a top view of a system relative to a transpiring, thermo-acoustic "disposable" formwork in accordance with the present invention, including a plurality of spacing connectors referred to in the present invention, assembled in accordance with a preferred variant of this invention.

Please also note, by way of example only—and by referring to the example in FIG. 7—that the space placed in between the panels 10 facing the transpiring, thermo-acoustic "disposable" formwork 11 can be changed by merely placing two or several spacing connectors 1 referred to in the present invention in between such panels, for instance said panels being connected between the respective (and facing) connecting means by placing a corresponding connection profile 33 in between, the latter profile being properly shaped, for instance, to correspond with the dovetail profiles 7 (if any) found on the connection portions 5 of such spacing connectors 1 themselves.

Figure 12:
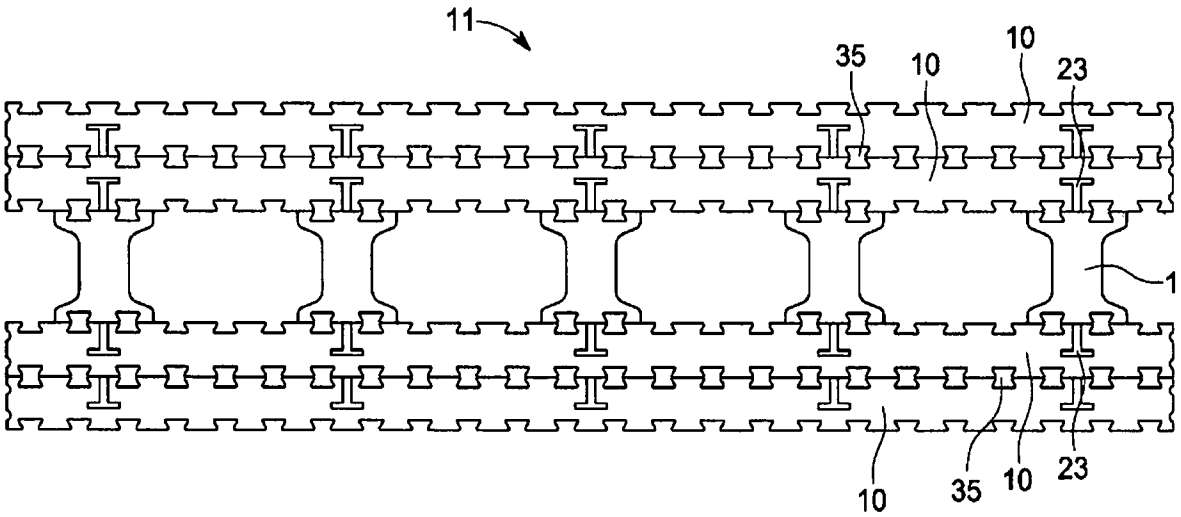
FIG. 12 shows a top view of the system relative to a transpiring, thermo-acoustic "disposable" formwork in accordance with the present invention, in a possible assembling configuration.
Figure 14:
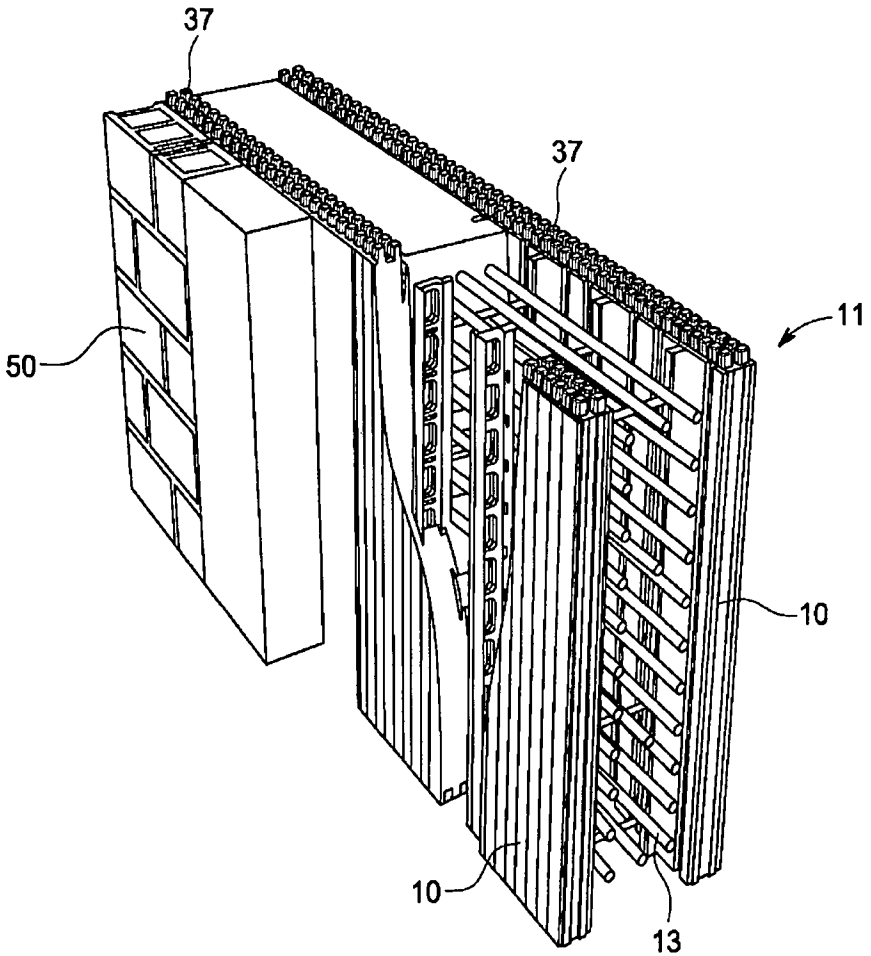
FIG. 14 shows a perspective top view of the formwork system in accordance with the present invention, in one further possible assembling configuration.

In addition, as you can notice in FIGS. 12 and 14 in particular, the system referred to in the present invention makes it possible to connect two or several panels 10 to one another in a planar fashion, by also placing between the same, if necessary, other layers 50 made of different materials (such as, for instance, wood, MDF, brick, crushed shard, stone, concrete wood, cellular concrete, etc.), in order to increase the thickness of the walls of the transpiring, thermo-acoustic "disposable" formwork 11 and also achieve an increase in noise breaking along the junction lines among such panels 10. Here too, several panels may be connected to one another in a planar fashion by placing a corresponding connection profile 35 in between, the latter profile impregnating the corresponding lock-in profiles 27 of panels 10 themselves.

The modular construction system referred to in the present invention will therefore make it possible, by making use of spacing connectors 1 and of panels 10, to obtain the following advantages:

top modular design in the making of transpiring, thermo-acoustic "disposable" formworks 11 featuring any one form, and for building any one building structure, i.e. foundations in the most varied monolith masonry shapes and/or unidirectional and bi-directional lofts and unidirectional and bi-directional monolith slabs;

the making of a horizontal and vertical transpiration grid created by the cooperation between the transpiration ducts of spacing connectors 1 and the junction lines between panels 10;

the possibility of making a transpiring, thermo-acoustic "disposable" formwork 11 that will make it possible to cast a resulting non-monolith beam-network structure instead of making use of the formworks peculiar to the method known as the English term "flat-type ICF).

FIGS. 16A, 16B, 16C, 16D, and 16E show preferred construction variants (with no limitation thereto) of connector 1 referred to in this invention. FIGS. 17A, 17B, and 17C, show another preferred construction variant (with no limitation thereto) of connector 1 referred to in this invention. FIGS. 18A, 18B, 18C, and 18D, FIGS. 19A, 19B, and 19C, show another preferred construction variant (with no limitation thereto) of connector 1 referred to in this invention. FIGS. 20A, 20B and 20C, show another preferred construction variant (with no limitation thereto) of connector 1 referred to in this, invention.

Many modifications and other embodiments of the inventions set forth herein will come to mind to one skilled in the art to which these inventions pertain having the benefit of the teachings presented in the foregoing description and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. in this regard, for example, different combinations of elements and/or functions than those explicitly described above arc also contemplated as may be set forth in some of the appended claims. Although specific terms are employed herein, they are used in a generic and descriptive sense only and not for purpose of limitation.

The invention claimed is:

1. A variable-geometry spacing connector made up of at least one crosspiece, said crosspiece being connected at both of opposite ends of said crosspiece, with at least one respective connection portion suited to make a connection with at least one panel of a formwork, wherein said spacing connector also includes at least one transpiration duct featuring two respective end openings, each of said end openings leading to a respective said connection portion, said transpiration duct being equipped with at least one check device suited to act in favour of a pressure difference existing between said end openings, wherein said transpiration duct is made up of at least one first partition, including one first half of said duct, connected with at least one second partition, including one second half of said duct, by placing at least one hinged mechanism therebetween.

2. The spacing connector in accordance with claim 1, where said transpiration duct consists of at least one pipe running through said crosspiece among said connection portion.

3. The spacing connector in accordance with claim 2, wherein each end of said pipe features at least one thread used to connect a plurality of additional lock-in profiles to fit with a corresponding profile of said panel, wherein said lock-in profiles further comprising a hole corresponding to at least one end opening of said transpiration duct.

4. The spacing connector in accordance with claim 1, wherein said at least one first partition partitions and said at least one second_partition feature a well suited to accommodate at least one check valve.

5. The spacing connector in accordance with claim 1, wherein said spacing connector comprises at least two half-parts able to be connected with each other either horizontally or vertically along said crosspiece.

6. The spacing connector in accordance with claim 5, wherein both of said half-parts are hollow inside.

7. The spacing connector in accordance with claim 1, wherein said spacing connector includes at least one metal core placed inside at least said crosspiece.

8. The spacing connector in accordance with claim 1, wherein said pipe is made of metal.

9. The spacing connector in accordance with claim 7, wherein said spacing connector has a length of at least 150.00 cm and further that said length is a multiple of 1.25.

10. The spacing connector in accordance with claim 1, wherein said spacing connector includes plurality of modular connecting elements shaped to correspond with connecting means of connection portions to connect several of said connectors in series with one another.

11. The spacing connector in accordance with claim 1, wherein connection portions are equipped with at least one respective removable fin that can be taken off said connector portion along a score line.

12. The spacing connector in accordance with claim 1, wherein said spacing connector is suited to integrally join a plurality of mutually inserted lock-in profiles integrated with one another by means of dovetails.

13. A modular construction system for making a modular, transpiring, thermo-acoustic disposable formwork, wherein said construction system includes panels and spacing connectors in accordance with claim 1, said panels being connected with one another by placing said spacing connectors between, said spaced apart panels, each of said panels having a plurality of lock-in profiles, each of said panels coupled with a respective corresponding lock-in profile of said spacing connectors, suited to make it possible to insert said spacing connectors within the lock-in profiles of said panels.

14. The variable-geometry spacing connector in accordance with claim 1, wherein said transpiration duct being equipped with at least one check device suited to act in favour of a pressure difference existing between said end openings.

15. The variable-geometry spacing connector in accordance with claim 1, wherein said crosspiece comprises at least two housing seats to accommodate at least one reinforcement iron, said at least two housing seats being placed by a pitch of 2.5 cm from another.

* * * * *